US011110480B2

(12) United States Patent
Cozzari

(10) Patent No.: US 11,110,480 B2
(45) Date of Patent: Sep. 7, 2021

(54) PAINTING AND DRYING BOOTH

(71) Applicant: GJ SERVICE S.R.L., Carrara (IT)

(72) Inventor: Marta Maria Cozzari, Perugia (IT)

( * ) Notice: Subject to any disclaimer, the term of this patent is extended or adjusted under 35 U.S.C. 154(b) by 133 days.

(21) Appl. No.: 16/609,067

(22) PCT Filed: May 17, 2018

(86) PCT No.: PCT/EP2018/062855
§ 371 (c)(1),
(2) Date: Oct. 28, 2019

(87) PCT Pub. No.: WO2018/210991
PCT Pub. Date: Nov. 22, 2018

(65) Prior Publication Data

US 2020/0055074 A1 Feb. 20, 2020

(30) Foreign Application Priority Data

May 18, 2017 (IT) ..... 102017000054267

(51) Int. Cl.

| | |
|---|---|
| ***B05B 16/20*** | (2018.01) |
| ***F26B 3/30*** | (2006.01) |
| ***B05C 15/00*** | (2006.01) |
| *F21V 21/30* | (2006.01) |
| *F26B 19/00* | (2006.01) |
| *F26B 25/06* | (2006.01) |

(52) U.S. Cl.
CPC ..... *B05B 16/20* (2018.02); *B05C 15/00* (2013.01); *F26B 3/30* (2013.01); *F21V 21/30* (2013.01); *F26B 19/00* (2013.01); *F26B 25/06* (2013.01); *F26B 2210/12* (2013.01)

(58) Field of Classification Search
None
See application file for complete search history.

(56) References Cited

U.S. PATENT DOCUMENTS

| | | | | |
|---|---|---|---|---|
| 3,561,135 | A * | 2/1971 | Fulford | B05B 16/60 34/224 |
| 5,224,974 | A * | 7/1993 | Johnson | B05B 14/43 600/453 |
| 5,968,271 | A * | 10/1999 | Maxwell | B05B 13/005 118/671 |
| 2003/0177978 | A1* | 9/2003 | Nobutoh | G05B 19/401 118/663 |
| 2007/0274083 | A1 | 11/2007 | Williams et al. | |

FOREIGN PATENT DOCUMENTS

| | | |
|---|---|---|
| BE | 1013673 A6 | 6/2002 |
| EP | 1635110 A2 | 3/2006 |

OTHER PUBLICATIONS

International Search Report for corresponding PCT/EP2018/062855.
Written Opinion of the ISA for corresponding PCT/EP2018/062855.

* cited by examiner

*Primary Examiner* — Jethro M. Pence
(74) *Attorney, Agent, or Firm* — Egbert, McDaniel & Swartz, PLLC

(57) ABSTRACT

A painting and drying booth includes at least one surface-mounted luminaire having a frame with a box body that defines a compartment provided with a front opening, an electromagnetic radiation source in the compartment, a mobile screen, at least one actuation device to move the screen; the actuation device is of articulated parallelogram type in such a way to move the screen with a roto-translation movement, during which the screen always lies on the same plane.

9 Claims, 4 Drawing Sheets

PAINTING AND DRYING BOOTH

The present patent application for industrial invention relates to a painting and drying booth for products in general, in particular for motor vehicles, comprising improved surface-mounted luminaires.

Painting and drying booths are known, which are used for painting a product and drying the paint on the product. Generally speaking, the painting of a product in one of said booths provides for a first step, wherein the paint is sprayed on the product, and a second step, wherein the product is irradiated with electromagnetic radiation in order to dry the paint on the product.

The electromagnetic radiation is produced with by means of surface-mounted luminaires installed in the painting and drying booth. Each surface-mounted luminaire comprises a frame that defines a compartment and is provided with a front opening to access the compartment. Each surface-mounted luminaire comprises a source of electromagnetic radiation disposed in the compartment of the surface-mounted luminaire.

The electromagnetic radiation permits to dry the paint on the product in a rapid, uniform way, obtaining a high-quality finish without generating any thermal stress on the product.

As it is known, electromagnetic radiation may be extremely dangerous for human beings. Moreover, electromagnetic sources are delicate and can get easily damaged, especially if said electromagnetic radiation sources come in contact with dust and substances dispersed in the air during the first painting step.

In order to avoid such an inconvenience, the surface-mounted luminaires are provided with a mobile partition, which is suitable for closing the front opening used to access the compartment, in such a way to act as protection screen both for the operators in the booth and for the electromagnetic radiation source, without interfering with the transmission of the electromagnetic radiations.

Said mobile partition is usually moved by moving means in up-down direction, like a roller shutter, closing the front opening of the frame by going from up down in order to be disposed with its lower edge against the frame.

However, it must be noted that empty spaces are left between the partition and the sliding guides of the partition, also when the partition is closed, it being evident that in order to permit said sliding movement, a minimum clearance must be provided between the partition and the sliding guides, said clearance being responsible for the formation of said empty spaces through which the fine dust and the substances dispersed in the air can penetrate the compartment of the surface-mounted luminaire.

The dust and substances that penetrate the compartment of the surface-mounted luminaire may come in contact with the electromagnetic radiation source, thus deteriorating the quality of the radiation emitted from said electromagnetic radiation source.

The purpose of the present invention is to overcome the drawbacks of the prior art by devising a painting and drying booth comprising surface-mounted luminaires provided with a mobile screen, which is not impaired by the aforementioned drawbacks with reference to the shutter-type partitions that are currently used.

Another purpose is to disclose a surface-mounted luminaire for painting and drying booths, provided with a mobile screen with tight seal against the support frame, in such a way to prevent the penetration of dust and substances dispersed in the air into the compartment of the surface-mounted luminaire.

The painting and drying booth according to the invention comprises walls that define a compartment and at least one surface-mounted luminaire disposed inside a housing obtained in one of the walls of the painting and drying booth. Said at least one surface-mounted luminaire comprises a frame comprising a box body defining a compartment provided with a front access opening that faces the interior of the painting and drying booth.

The surface-mounted luminaire comprises an electromagnetic radiation source disposed in the compartment of the box body and a mobile screen connected to the frame in order to close the front opening of the box body.

The surface-mounted luminaire comprises at least one actuation device connected to the frame and to the screen in order to move the screen with respect to the frame.

The peculiarity of the painting and drying booth according to the invention consists in the fact that the frame also comprises a plate-like frame that surrounds the front opening of the compartment and in the fact that the actuation device is of articulated parallelogram type in such a way to move the screen with a roto-translation movement, while always maintaining the screen on the same plane.

The actuation device comprises a motorized actuation pin and two levers, each of them having a first end connected to the frame and a second end connected to the screen. One of the levers is prismatically coupled with the actuation pin.

Following to the rotation of the actuation pin, the screen is moved from a closing position, wherein it is engaged against said frame, sealing the front opening, to an opening position, wherein it has translated next to the front access opening and does not cover said front access opening.

For the sake of clarity, the description of the painting and drying booth according to the invention continues with reference to the attached drawings, which have a merely illustrative, not limiting value, wherein.

Figure 1:
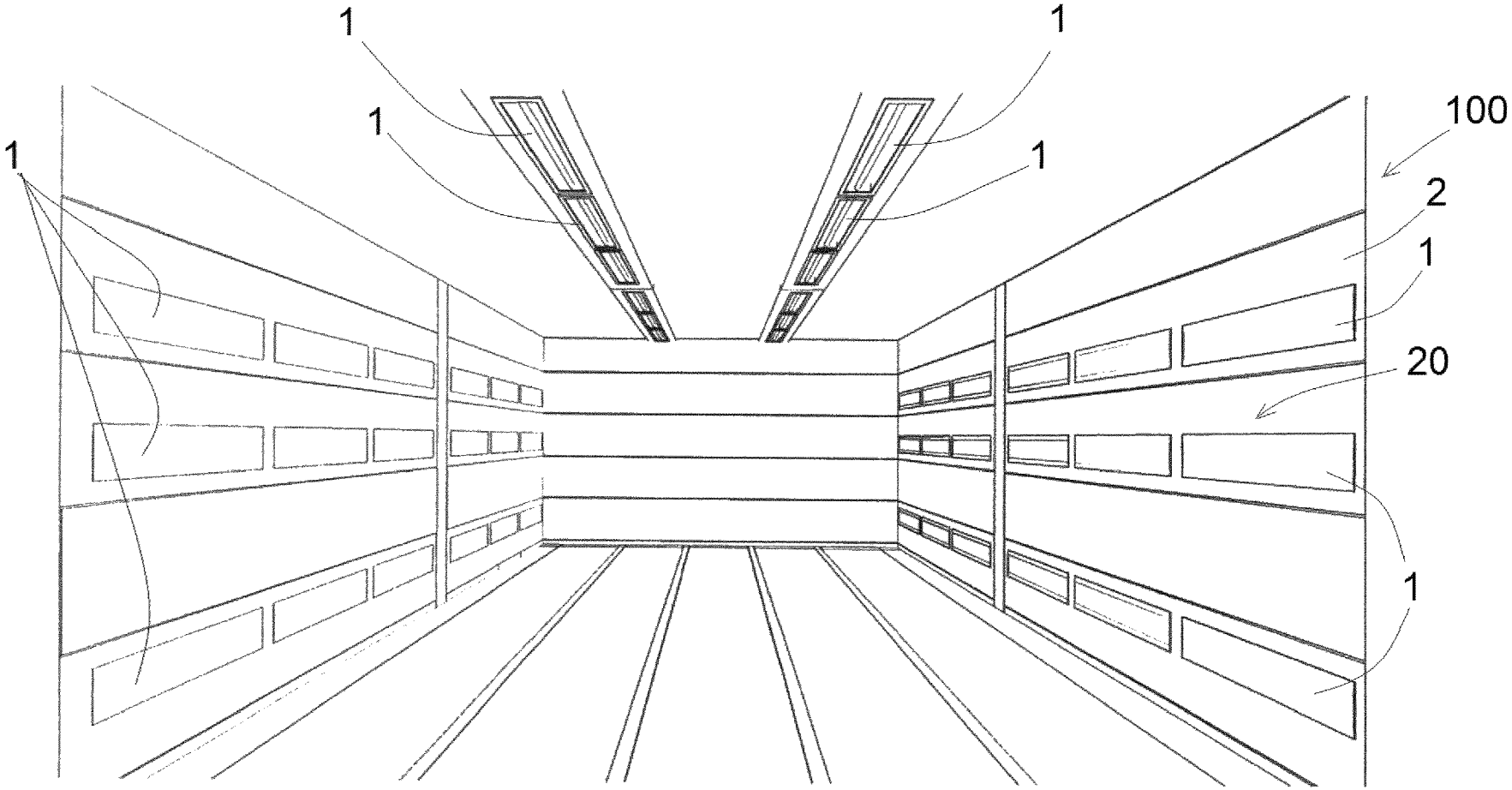
FIG. 1 is a perspective view of a painting and drying booth according to the invention.

With reference to FIG. 1, a painting and drying booth according to the invention is disclosed, which is generally indicated with reference numeral (100).

The painting and drying booth (100) comprises walls (2) that define a compartment (20), wherein the product to be painted is disposed.

The painting and drying booth (100) also comprises a plurality of surface-mounted luminaires (1) that house an electromagnetic radiation source (R) of known type in order to dry the paint on the product. Each surface-mounted luminaire (1) is disposed in a housing that is obtained on the walls (2) of the painting and drying booth (100).

Figure 2:
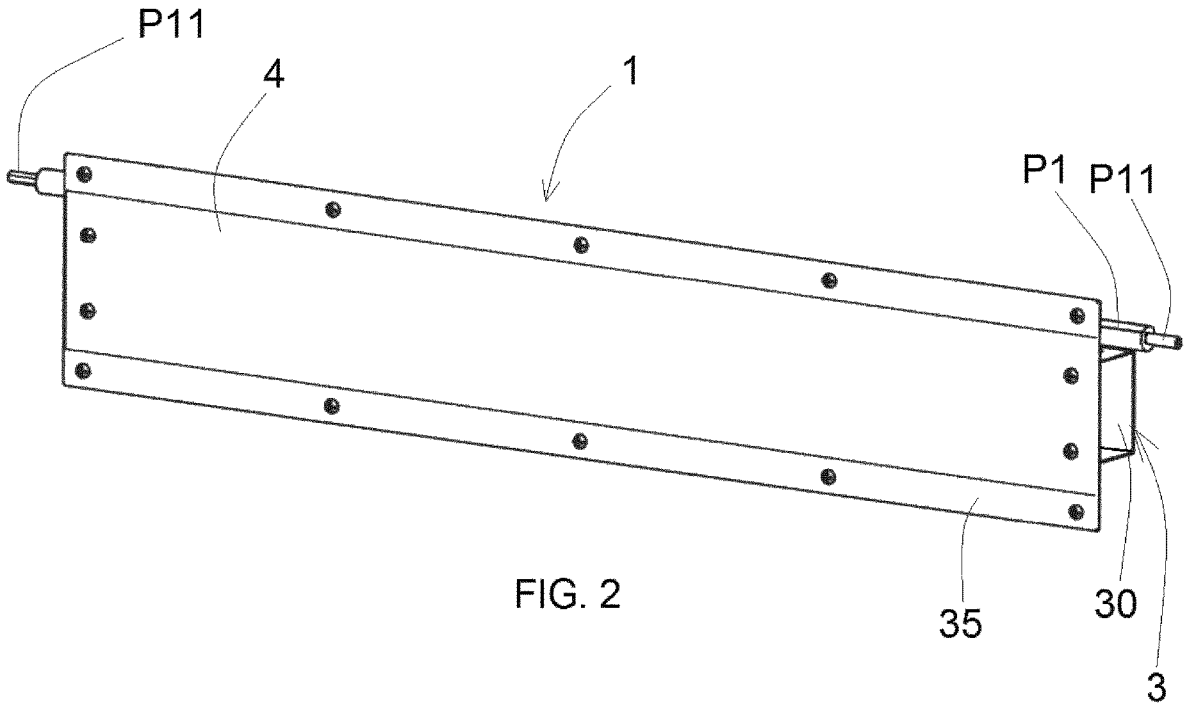
FIG. 2 is an axonometric view of a surface-mounted luminaire according to the invention, with a mobile screen in closing position.
Figure 4:
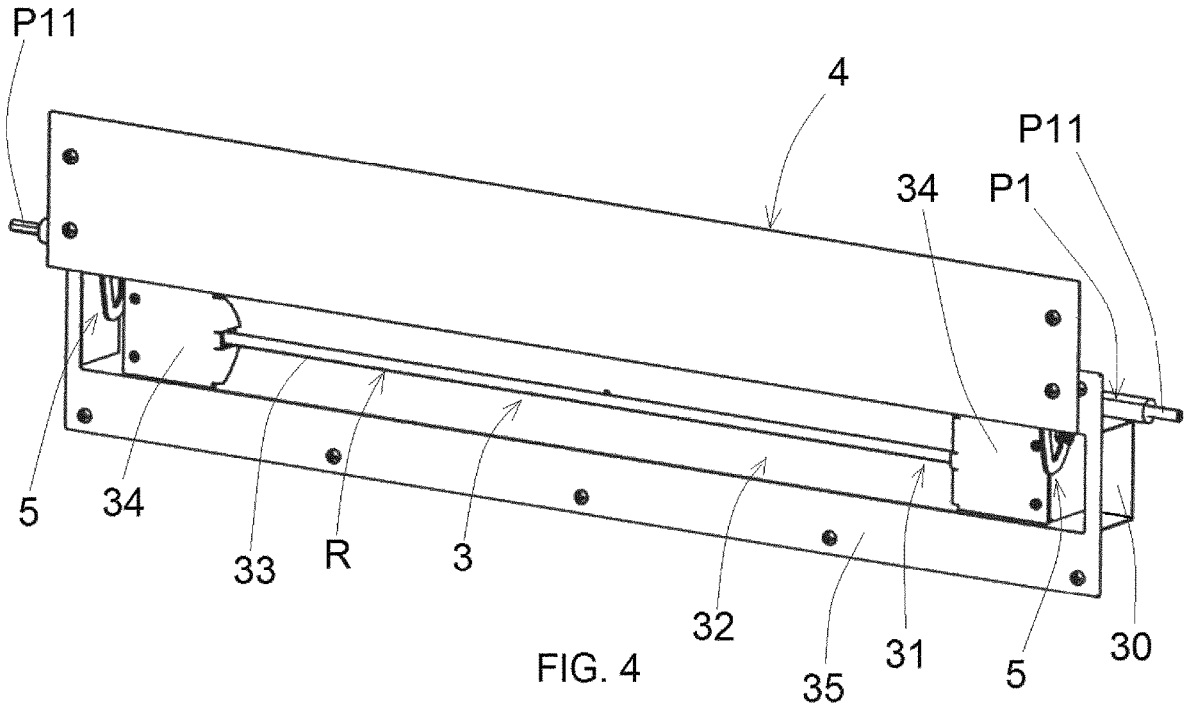
FIG. 4 is an axonometric view of the surface-mounted luminaire according to the invention, with a mobile screen in opening position.

With reference to FIGS. 2 and 4, each surface-mounted luminaire (1) comprises a frame (3) provided with a box body (30) that defines a compartment (31) provided with a front opening (32). The front opening (32) faces the interior of the painting and drying booth (100).

The compartment (31) houses said electromagnetic radiation source (R), which comprises an infrared lamp (33) suitable for emitting infrared radiation in order to dry the paint on the products. The frame (3) comprises supports (34) disposed in the compartment (31) and connected at the ends of the infrared lamp (33) in order to support the infrared lamp (33).

The frame (3) is frontally provided with a plate-like frame (35) that surrounds the front opening (32) of the compartment (31). The clearance of the frame (35) is longer than the box body (30), in such a way that an empty space is left between the lateral wall of the box body (30) and the lateral side of the clearance of the frame (35).

The surface-mounted luminaire (1) comprises a mobile screen (4) connected to the frame (3) in order to close the front opening (32) of the compartment (31), being stopped against the frame (35). The screen (4) is longer than the clearance of the frame (35).

The screen (4) is moved by means of a pair of identical motorized actuation devices (5), each of them being connected to one of the lateral walls of the box body (30) on one side, and to the screen (4) on the other side in order to let the screen (4) move with respect to the box body (30).

In particular, the actuation device (5) is of articulated parallelogram type in such a way to move the screen (4) with a roto-translation movement, during which said screen (4) always lies on the same plane.

Figure 3:
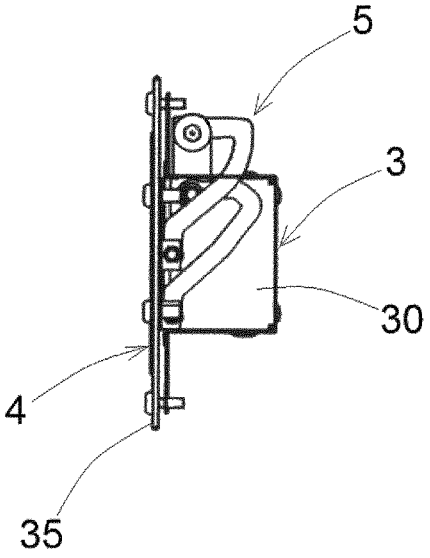
FIG. 3 is a side view of the surface-mounted luminaire of FIG. 2.
Figure 5:
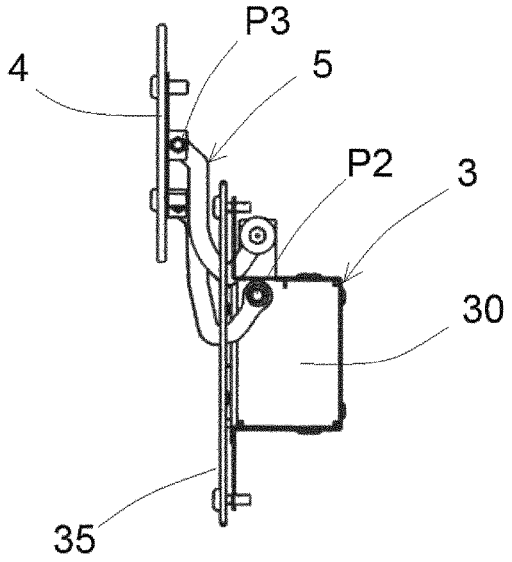
FIG. 5 is a side view of the surface-mounted luminaire of FIG. 4.

The actuation devices (5) move the screen (4) between a closing position, as shown in FIGS. 2 and 3, wherein the screen (4) is engaged against the frame (35), sealing the front opening (32) of the compartment (31), in such a way to prevent dust and substances dispersed in the air from penetrating the compartment (31) of the box body (30), and an opening position, as shown in FIGS. 4 and 5, wherein the screen (4) has translated next to the front opening (32) and does not cover said front opening (32).

When the screen (4) is in opening position, the screen (4) is disposed above the front opening (32) of the compartment (31). When the screen (4) is in closing position, the screen (4) is stopped against the frame (35).

Figure 6:
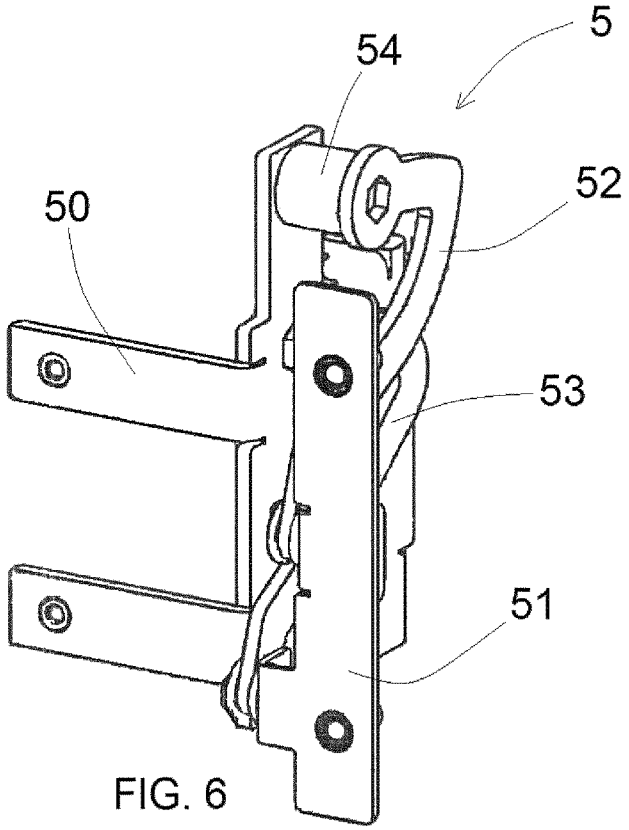
FIG. 6 is an axonometric view of a moving device of the mobile screen of the surface-mounted luminaire according to the invention.
Figure 7:
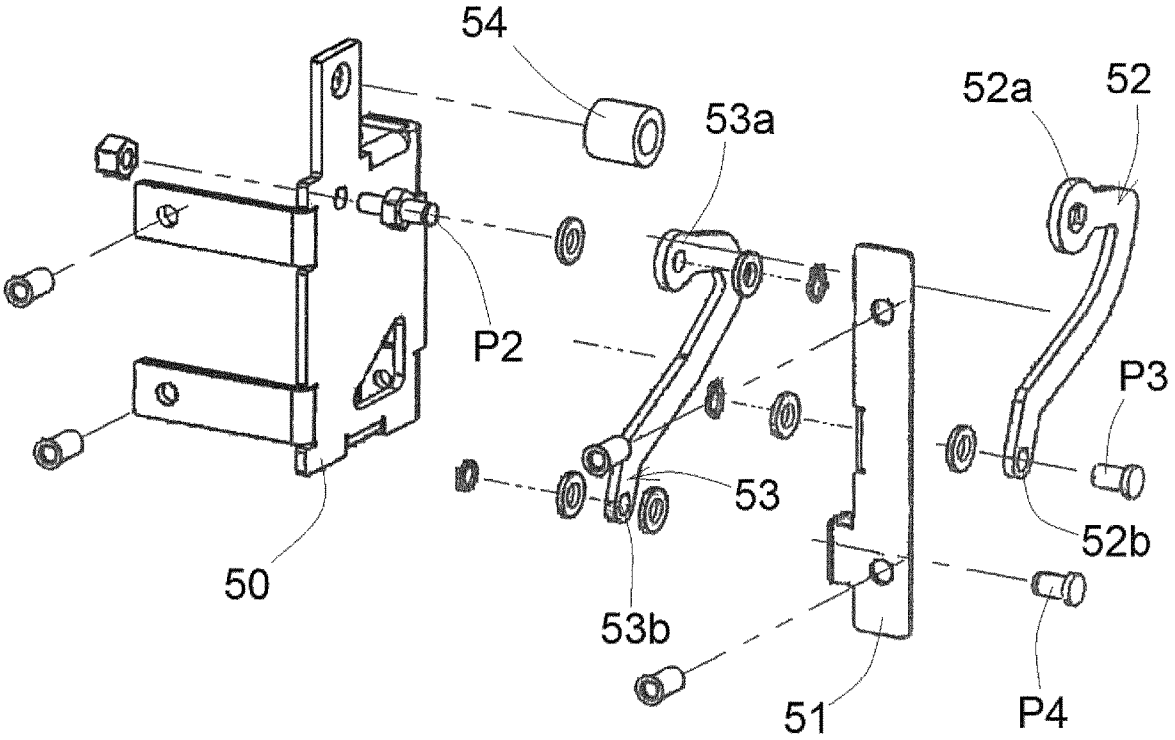
FIG. 7 is the same as FIG. 6, except for it shows the moving device in an exploded view.

With reference to FIGS. 6 and 7, each actuation device (5) comprises a first fixing element (50) fixed to the lateral wall of the box body (30) of the frame (3) and a second fixing element (51) fixed to the back wall of the screen (4) near the ends of the screen (4).

With reference to FIGS. 2 and 4, a motorized horizontal shaft (P1) is connected to both actuation devices (5) for the simultaneous synchronized actuation of the two actuation devices (5). The shaft (P1) is provided at its ends with two actuation pins (P11) with hexagonal section. One or both ends of the shaft (P1) are connected to an automatic piston that drives the shaft (P1) into rotation.

The actuation device (5) comprises two identical levers (52, 53). In particular, the actuation device (5) comprises a first lever (52) provided with a first end (52*a*) coupled with the first fixing means (50) by means of one of the two actuation pins (P11) of the shaft (P1), and a second end (52*b*) pivoted to the second fixing element (51) by means of a first horizontal pin (P3).

The first end (52*a*) of the first lever (52) is provided with a bush with a hexagonal hole which is prismatically coupled with the actuation pin (P11) of the shaft (P1), in such a way that, by moving the shaft (P1), the actuation pin (P11) drives the first lever (52) into rotation.

With reference to FIGS. 2 and 4, the shaft (P1) is longer than the frame (3), in such a way as to be connected to the first lever (52) of both actuation devices (5).

The actuation device (5) comprises a second lever (53) provided with a first end (53*a*) pivoted at the first fixing means (50) by means of a second pin (P2), and a second end (53*b*) pivoted to the second fixing element (51) by means of a third horizontal pin (P4).

The provision of two levers (52, 53) prevents the screen (4) from making rotary movements around its axis when it is moved.

With reference to FIGS. 6 and 7, each lever (52, 53) is advantageously provided with a "V" shape comprising a first rectilinear arm ending with the first end (52*a*, 53*a*), and a second curvilinear arm that is longer than the first arm and ends with the second end (53*a*, 53*b*). Because of such a shape, the levers (52, 53) do not interfere with the upper edge of the clearance of the frame (35) when the levers (52, 53) are moved upwards. In fact, when moving upwards, the levers (52, 53) pass through the empty space between the lateral wall of the box body of the frame (3) and the lateral edge of the clearance of the frame (35).

The levers (52, 53) are partially overlapped. The first lever (52) is spaced from the first fixing element (50) by means of a spacer (54), in such a way that the first lever (52) does not interfere with the second lever (53), which is disposed between the first lever (52) and the first fixing element (50).

In order to close the front opening (32) of the compartment (31), the shaft (P1) must be driven into rotation, thus rotating the first lever (52) of the actuation devices (5) by means of the actuation pins (P11) in such a way that said first lever (52) rotates downwards, moving the screen (4). Likewise, the second lever (53) rotates, being driven by the movement of the screen (4).

During the movement of the screen (4) from the opening step to the closing step and vice versa, the screen (4) moves in parallel direction, maintaining its position. In particular, the screens (4) of the surface-mounted luminaires (1) on the vertical surfaces of the painting and drying booth (100) are moved while constantly keeping a vertical position, whereas those mounted on the ceiling of the painting and drying booth (100) are moved while keeping their horizontal position.

During the closing of the surface-mounted luminaire (1), the screen (4) moves along a circular trajectory, while always keeping a parallel position with respect to the plane of the frame (35) of the frame (3) whereto said screen (4) is associated, and at the end of said travel the screen (4) is rested and engaged against said frame (35), providing a seal-tight closing of the compartment (31) with the electromagnetic radiation source (R). This avoids the formation of empty spaces that may allow the dust and substances dispersed in the air to penetrate the compartment (31) of the box body of the frame (3).

Optionally, a seal (not shown in the figure) is disposed around the clearance of the frame (35). The screen (4) is compressed against the seal when it is in closing position to hermetically close the compartment (31) of the box body of the frame (3).

Although not shown in the attached figures, the actuation devices (5) may comprise levers with a different shape, such as for example a rectilinear shape. Moreover, the actuation devices (5) may be configured in such a way that, when in the opening position, the screen (4) is disposed in lower position with respect to the front opening (32) of the compartment (31).

Although not shown in the figures, the surface-mounted luminaire (1) may comprise only one actuation device (5). In such a case, the provision of the shaft (P1) is not necessary. In fact, the provision of a motorized actuation pin (P11), which is prismatically coupled with the first lever (52) of the actuation device (5), is sufficient.

Alternatively, the surface-mounted luminaire (1) may comprise two actuation devices (5), without the shaft (P1). In such a case, the first lever (52) of each actuation device (5) is prismatically coupled with an actuation pin (P11) and each actuation pin (P11) is connected to an electrical motor that is controlled by means of a control unit. In such a case, the synchronization of the actuation devices is guaranteed by the control unit. Although not shown in the figures, the actuation pin (P11) may be coupled with the second lever.

The invention claimed is:

1. A painting and drying booth comprising:

a plurality of walls that define an interior; and at least one surface-mounted luminaire disposed inside, a housing in one of said plurality of walls, said at least one surface-mounted luminaire comprising:

a frame having a box body that defines a compartment with a front opening facing the interior defined by said plurality of walls;

an electromagnetic radiation source disposed in the compartment of the box body;

a mobile screen connected to said frame so as to enclosed the front opening of the compartment; and at least one actuation device connected to said frame and to said mobile screen so as to move said mobile screen, relative to said frame, wherein said frame has a plate shape that surrounds the front opening of the compartment, wherein said at least one actuation device has an articulated parallelogram configuration so as to move said mobile screen with a roto-translation movement such that said mobile screen always resides in a common plane, said at least one actuation device comprising a motorized actuation pin and a pair of levers, each of the pair of levers having a first end connected to said frame and a second end connected to said mobile screen, one of said pair of levers being prismatically coupled to the motorized actuation pin, wherein said mobile screen moves between a closing position engaged against said frame and an opening position translated adjacent the front opening but not covering the front opening, the motorized actuation pin being rotatable so as to move said mobile screen between the closing position and the opening position.

2. The painting and drying booth of claim 1, wherein the first end of one of the pair of levers has a bush having a hexagonal hole, the first end of the one of the pair of levers being prismatically coupled to the motorized actuation pin.

3. The painting and drying booth of claim 1, wherein a length of clearance of said frame is greater than a length of the box body such that an empty space is defined between a lateral wall of the box body and a lateral side of the clearance of said frame, the empty space housing the pair of levers of said at least one actuation device.

4. The painting and drying booth of claim 3, wherein said at least one surface-mounted luminaire comprises a seal disposed around the clearance of said frame.

5. The painting and drying booth of claim 3, said at least one actuation device comprising:

a first fixing element affixed to the lateral wall of the box body and to the first end of the pair of levers; and a second fixing element affixed to said mobile screen and to the second end of the pair of levers.

6. The painting and drying booth of claim 5, wherein said at least one actuation device comprises a spacer that spaces the first lever from said first fixing element.

7. The painting and drying booth of claim 1, wherein each of the pair of levers has a generally V-shape with a first rectilinear arm ending at the first end and a second curvilinear arm ending at the second end, the second curvilinear arm having a length greater than a length of the first rectilinear arm.

8. The painting and drying booth of claim 1, wherein at least one surface-mounted luminaire comprises a pair of identical actuation devices each being connected to a lateral wall of the box body and to said mobile screen, said at least one surface-mounted luminaire having a motorized shaft connected to the pair of identical actuation devices for simultaneously synchronized actuation of the pair of identical actuation devices, the motorized shaft ending with the motorized actuation pin.

9. A surface-mounted luminaire for a painting and drying booth, the surface-mounted luminaire comprising:

a frame having a box body defining an interior with a front opening;

an electromagnetic radiation source disposed in the interior of the box body;

a mobile screen connected to said frame and adapted to close the front opening; and at least one actuation device connected to said frame and to said mobile screen in order to move said mobile screen with respect to said frame, wherein said at least one actuation device has an articulated parallelogram configuration so as to move said mobile screen with a roto-translation movement such that said mobile screen always resides in a common plane, said at least one actuation device comprising a motorized actuation pin and a pair of levers, each of the pair of levers having a first end connected to said frame and a second end connected to said mobile screen, one of said pair of levers being prismatically coupled to the motorized actuation pin, wherein said motorized screen moves between a closing position engaged against said frame and an opening position translated adjacent the front opening but not covering the front opening, the motorized actuation pin being rotatable so as to move said mobile screen between the closing position and the opening position.

* * * * *